United States Patent [19]

Kerr

[11] 4,039,993

[45] Aug. 2, 1977

[54] OVER TEMPERATURE LIMIT SWITCH

[75] Inventor: Maxwell A. Kerr, Jackson, Mich.

[73] Assignee: Mechanical Products, Jackson, Mich.

[21] Appl. No.: 693,218

[22] Filed: June 4, 1976

[51] Int. Cl.[2] ..... H01H 37/54; H01H 37/66

[52] U.S. Cl. ..... 337/366; 335/31; 335/145; 337/344

[58] Field of Search ..... 337/54, 90, 344, 366, 337/134, 379; 335/31, 145

[56] References Cited

U.S. PATENT DOCUMENTS

| | | | |
|---|---|---|---|
| 3,011,037 | 11/1961 | Welsh | 337/90 |
| 3,728,658 | 4/1973 | Kasahara | 337/90 |

FOREIGN PATENT DOCUMENTS

| | | | |
|---|---|---|---|
| 2,269,183 | 11/1975 | France | 337/54 |

*Primary Examiner*—Robert J. Hickey

*Attorney, Agent, or Firm*—Harness, Dickey & Pierce

[57] ABSTRACT

The disclosure relates to an over-temperature limit switch for automatically making or breaking an electrical circuit at a predetermined temperature. The actuating force for the switch is provided by a temperature dependent bimetallic spring and the latching function of the switch is provided by a pair of magnets. One of the magnets, a permanent magnet, is secured to the bimetallic spring and the other magnet, a non-permanent or "soft" magnet, is disposed in the base of the switch opposite the permanent magnet. The non-permanent magnet has a transition temperature associated therewith indicating the temperature above which the permeability of the magnet diminishes to such an extent that it can no longer carry sufficient magnetic lines of flux from the permanent magnet to hold it against the force of the bimetallic spring. The bimetallic spring is adapted to exert a bias force tending to open the switch at a temperature below the transition temperature of the non-permanent magnet. In this manner, the switch "snaps" open when the transition temperature of the magnet is reached. When the temperature of the switch cools below the transition temperature of the switch, the permeability of the non-permanent magnet is restored and the switch "snaps" shut as the bimetallic spring returns the permanent magnet to within close proximity of the non-permanent magnet. Alternative embodiments are also disclosed for varying the operating temperatures of the switch.

24 Claims, 5 Drawing Figures

OVER TEMPERATURE LIMIT SWITCH

BACKGROUND AND SUMMARY OF THE PRESENT INVENTION

The present invention relates to a temperature limit switch that automatically makes or breaks an electrical circuit at predetermined operating temperatures.

As a result of relatively recent advances, there has been developed a new type of non-permanent magnet which has a magnetic transformation point at temperatures relatively near ambient temperature. In particular, with certain compositions, it has been found that considerable variations in the magnetic properties of the composition can be realized with comparatively small changes in the temperature of the composition around its magnetic transformation point. Such a material has been used in temperature compensation of electrical indicating instruments, and in temperature control devices for convection heaters.

One such application wherein the magnetic transformation point of a non-permanent magnetic material is used as the magnetic release for a thermal control device is a new type of temperature sensing reed switch. A typical reed switch of this type comprises a pair of spring tension reeds disposed along the axis of a pair of toroidal-shaped permanent magnets, separated by a non-permanent ferro-magnetic material whose magnetic reluctance varies with temperature within a narrow range around its magnetic transformation point. At temperatures below the magnetic transformation point, or transition temperature, of the non-permanent magnet, the ferro-magnetic material conducts magnetic flux lines from the adjacent permanent magnets, thereby maintaining a strong magnetic field around the area of the reed contacts keeping the switch closed. When the temperature rises above the transition temperature, the ferro-magnetic or ferri-magnetic material is substantially eliminated as a magnetic flux line carrying device. Thus, a weak magnetic field is produced in the area of the reed contacts which is overcome by the spring tension of the reeds opening the switch.

Although adequate in their performance, thermal control devices of this type do not provide the precise temperature control required for certain applications. In addition, should the magnetic properties of the magnetic switch be affected by external forces, or for some other reason fail to properly operate, the control device would become completely inoperative.

The present invention seeks to overcome these disadvantages by providing an over-temperature limit switch that combines the use of a non-permanent, or "soft" magnet as part of a temperature responsive latch, and a bimetallic temperature dependent spring as the actuating force of the switch. In this manner, the operating temperatures of the switch can be controlled to within a tolerance of $\pm 1.5\%$ of the temperature rise above room temperature (25° C). Furthermore, since the actuating force of the spring is also sensitive to temperature changes, the present switch will operate within approximately 30° C of its rated operating temperatures in the event the magnetic latch of the switch fails to properly function. Thus, the present switch provides a built-in "fail safe" feature which will prevent a possible dangerous increase in the temperature of the device which the switch is intended to control. Consequently, it will be appreciated that the present invention is particularily suited for use as a temperature cut-off safety device.

Alternative embodiments of the present invention additionally disclose means for adjusting the operating temperatures of the limit switch. This can be accomplished by adjusting the critical temperature and spring force of the bimetallic spring, or by applying compressible pressure to the "soft" non-permanent magnet of the magnetic latch to vary its magnetic properties. In another embodiment, a pair of non-permanent soft magnets having different transition temperatures is provided. By varying the proportion of each non-permanent magnet that is in magnetic contact with the pole face of the permanent magnet, the operating temperatures of the switch can be adjusted within the range of temperatures defined by the two transition temperatures of the non-permanent magnets.

In the preferred embodiment of the present invention, the bimetallic spring is affixed to the switch so that at room temperature (25° C) the bimetallic spring exerts a bias force tending to retain the contacts of the switch in their closed position. In addition, the switch is designed so that the bimetallic spring does not constitute part of the electrical circuit between the switch contacts. In this manner, the temperature of the bimetallic spring is not affected by the current to which the switch is subjected.

As the ambient temperature increases, the bimetallic spring is adapted to begin exerting a bias force tending to open the contacts of the switch. However, due to the magnetic latch the switch remains in its closed position until the ambient temperature reaches the transition temperature of the non-permanent magnet. When this occurs, the permeability of the non-permanent magnet rapidly decreases permitting the bimetallic spring to snap open the switch contacts. When the ambient temperature cools below the transition temperature of the non-permanent magnet, the permeability of the non-permanent magnet is restored. Thus, as the cooling bimetallic spring returns the permanent magnet to its original position, the switch contacts are snapped shut by the magnetic latch.

Other objectives, advantages and application of the present invention will be made apparent by the following detailed description of the preferred embodiments of the invention.

BRIEF DESCRIPTION OF THE DRAWINGS

The following detailed description of the preferred embodiments of the present invention makes reference to the following set of drawings in which.

DETAILED DESCRIPTION OF THE PREFERRED EMBODIMENTS

Figures 1, 2, 3, 4:
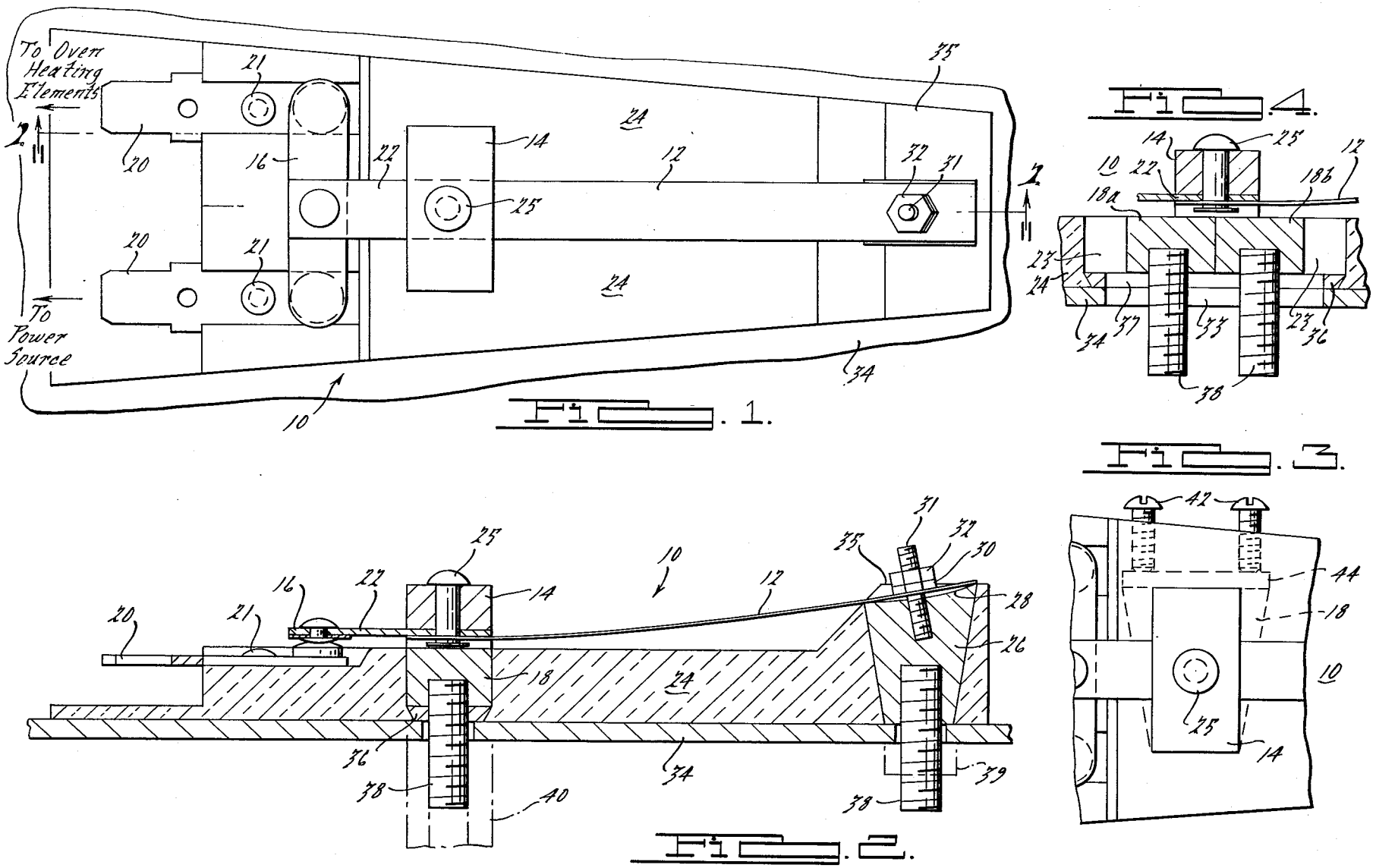
FIG. 1 is a plan view of an over-temperature limit switch according to the present invention.
FIG. 2 is a sectional view of the over-temperature limit switch shown in FIG. 1 taken along section line 2—2.
FIG. 3 illustrates an alternative embodiment of the over-temperature limit switch shown in FIG. 1.
FIG. 4 is another alternative embodiment of the over-temperature limit switch illustrated in FIGS. 1 and 2.

Referring to FIG. 1, an over-temperature switch 10 according to the present invention is shown. The limit switch 10 illustrated in the figures is depicted in typical application as a cut-off switch for an electrical oven. However, as will become readily apparent to those skilled in the art, the present invention is adaptable to a variety of applications where precise thermal control is desired.

The switch 10 in FIG. 1 is seen to comprise a pair of contacts 20 which are adapted to be connected in series with the electrical power supplied to the heating elements of the oven. An electrical connection is provided between the two contacts 20 by a contact jumper 16. The contacts 20 are mounted to the base 24 of the switch 10 by a pair of rivets 21. Since the switch 10 is intended to be mounted directly to the back of the oven wall 34, the base 24 of the switch 10 should be comprised of a material that will electrically insulate the contacts 20 from the metal wall 34 of the oven, and preferably provide thermal insulation from the heat of the oven wall 34 as well. The base 24 of the switch 10 in the preferred embodiment is comprised of a ceramic material, although a high temperature plastic could be used also.

The contact jumper 16 is actuable between an opened and closed position by a bimetallic strip spring 12 which is connected to the contact jumper 16 via an insulating tab 22. Insulating tab 22 insulates the bimetallic spring 12 from the current carrying contact jumper 16.

The switch 10 is specifically designed so that the current does not flow through the bimetallic spring 12. In this manner, the bimetallic spring 12 is isolated from the thermal effects of conducting the electrical power supplied to the heating elements of the oven. The advantage of this arrangement will be more fully explained later.

Bimetallic spring 12 is a temperature responsive device in that the amount and polarity of the force exerted by the spring varies with the ambient temperature. Numerous types of bimetallic springs having a variety of different force vs. temperature characteristics are commercially available. The bimetallic spring 12 used in the preferred embodiment is manufactured by W. M. Chace Co., and is identified by the manufacturing number 2500. For example, this particular bimetallic spring, at 0.020 inches thick and 0.25 inches wide, with an active length of 2 inches, provides a free blade deflection rate of $0.84 \times 10^{-3}$ inches per degree Fahrenheit ($0.595 \times 10^{-3}$ cm. per degree centigrade) rise above 25° C.

As best shown in FIG. 2, affixed to the bimetallic spring 12 at its junction with insulating tab 22, is a permanent magnet 14. Permanent magnet 14 is secured to insulating tab 22 and bimetallic spring 12 by a retaining rivet 25. Permanent magnet 14 is preferably comprised of iron or an iron alloy and has associated therewith a transition temperature which is substantially greater than the highest temperature to which the switch 10 will be subjected. Otherwise, if permanent magnet 14 were heated through its transition temperature, it would become permanently demagnetized until remagnetized by a factory operation.

Embedded within the base 24 of the switch 10 directly beneath permanent magnet 14 is a magnetic keeper 18. Magnetic keeper 18 is a "soft" or non-permanent magnet comprised of a ferro-magnetic or ferri-magnetic material. Non-permanent magnet 18 is characterized by its ability to lose its permeability as it is heated above its transition temperature, and to regain its permeability as it is cooled below its Curie temperature.

The transition temperature of magnetic keeper 18 is determined by the precise alloy mix of the ferro-magnetic or ferri-magnetic material, and as such, can be set to a wide range of temperatures depending upon the specific alloy mix used. Specifically, various nickel-iron and nickel-iron-zinc and/or manganese alloys have been found to possess the desired qualities for use in the present invention. For example, if the desired transition temperature of the magnetic keeper 18 is 310° C, an alloy mixture comprised of 39% nickel and the balance iron would be appropriate. Generally speaking, the Curie temperature of the magnetic material increases proportionately with an increase in the percentage of nickel in the nickel iron alloy.

The base 24 of the switch 10 has an elevated section 35 at one end, in which is embedded a support post 26. The end of the bimetallic spring 12 opposite the contact jumper 16 is secured to the top surface of the support post 26 by a bolt 31 and retaining nut 30. The top surface of the support post is inclined to slope downward toward the opposite end of the switch base 24 as shown, so that when mounted the bimetallic spring 12 will be slightly deflected between its ends. In particular, the degree of linear inclination in the top surface is such that at room temperature (25° C), bimetallic spring 12 will exert a bias force tending to retain contact jumper 16 in its closed position.

Additionally, it will be noted that the top surface of support post 26 is slightly curved, with the radius of the curve shortest near the uppermost part of the post 26, as indicated at 28. The curved seat of the support post 26 provides a means for varying the amount of bias force exerted by the bimetallic spring 12 on the contact jumper 16 by providing means for adjusting the particular angle at which the bimetallic spring 12 is mounted to the support post 26. To adjust the mounting angle of the spring 12, the retaining nut 30 is tightened on bolt 31 so that a greater portion of bimetallic spring 12 conforms to the curved seat of the mounting post 26. The adjustment is then held by tightening locking nut 32 against retaining nut 30. As will subsequently be explained in greater detail, by varying the amount of bias force exerted by bimetallic spring 12, the temperatures at which the limit switch 10 will open and close are also varied.

When used as a temperature cut-off switch for an electrical oven, the limit switch 10 is preferably mounted to the wall of the oven 34 with a high temperature ceramic cement. The ceramic cement provides electrical insulation between the switch 10 and the electrically grounded oven wall 34, as well as good mechanical strength and durability through repeated heating-cooling cycles.

To insure that the magnetic properties of magnetic keeper 18 are not affected by its proximity to the metal wall 34 of the oven, a non-magnetic spacer 36 is disposed between the magnetic keeper 18 and the wall 34 of the oven to magnetically isolate the magnetic keeper 18 from the oven wall 34. Spacer 36 is preferably comprised of a material such as brass or aluminum which also provides relatively high thermal conductivity so that the temperature of magnetic keeper 18 is maintained close to the temperature of the oven wall 34.

Similarly, support post 26 is comprised of a high thermally conductive material such as brass or cast iron so that the temperature of the bimetallic spring 12 will also be kept close to the temperature of the oven wall 34.

To further aid in maintaining the temperature of magnetic keeper 18 and bimetallic spring 12 close to oven air temperature, the limit switch 10 is preferably bolted to the wall 34 of the oven by a pair of stud bolts 38. Stud bolts 38 are comprised of a non-magnetic material having a high thermal conductivity, such as brass, and are threadedly secured to magnetic keeper 18 and support post 26. The bolts 38 can be fastened to the wall 34 of the oven either by a mounting nut 39 or, in the event that even greater heat transfer is desired, by a threaded brass rod 40 that will extend further into the oven air space. In this manner, it can be seen that the oven air temperature will be rapidly transferred to magnetic keeper 18 and bimetallic spring 12.

The operation of the over-temperature limit switch 10 according to the present invention will now be explained. Assuming that the switch 10 is designed to open at a temperature of 300° C, at approximately 270° C (or about 30° below the open temperature of the switch), the bimetallic spring 12 is adapted to cease exerting a bias force tending to hold contact jumper 16 against contact terminals 20, and begin exerting a bias force in the opposite direction tending to separate contact jumper 16 from contacts 20. This is referred to as the critical temperature of the bimetallic spring 12. At this point, however, switch 10 will remain in its closed position due to the magnetic attraction between permanent magnet 14 and magnetic keeper 18. As the temperature continues to rise toward 300° C, the approximate transition temperature of magnetic keeper 18, the permeability of magnetic keeper 18 will begin to decrease, thereby reducing the magnetic attraction between permanent magnet 14 and magnetic keeper 18. In addition, during this rise in temperature, the bias force exerted by bimetallic spring 12 tending to open the switch 10 will also continue to increase. When the ambient temperature reaches 300° C, the permeability of the magnetic keeper 18 will be reduced to such an extent that it can no longer carry a sufficient number of magnetic flux lines to overcome the force exerted by the bimetallic spring 12. Thus, at this point the switch 10 "snaps" open.

With the circuit to the heating elements of the oven broken, the temperature of the air within the oven begins to cool. As the temperature drops below the transition temperature of magnetic keeper 18, the permeability of magnetic keeper 18 is restored. However, at this point, the force of the bimetallic spring 12 and the distance between permanent magnet 14 and magnetic keeper 18 are too great for the magnetic attraction between the two magnets to overcome. As the ambient temperature continues to drop, the bimetallic spring 12 begins to return permanent magnet 14 to its original position until permanent magnet 14 is sufficiently close to magnetic keeper 18 so that the magnetic attraction between the two magnets snaps contact jumper 16 back across contact terminals 20. In this example, this will occur at about 280° C, or approximately 20° C below the open temperature of the switch 10.

As indicated in the above example, the switch 10 is preferably designed so that the bimetallic spring 12 has a critical temperature below the transition temperature of the magnetic keeper 18. The critical temperature of the bimetallic spring 12 is determined by three factors: the free blade deflection characteristics of the spring, the angle at which the spring is mounted, and the active length of the spring. Since the temperature at which the switch 10 will open is dependent in part on the force exerted by the bimetallic spring 12, it can be seen that by varying one of the three factors listed, the operating temperatures of the switch 10 can also be varied over a limited range.

For example, assuming all other factors remain constant, if the angle at which the bimetallic spring 12 is mounted is increased so that a greater bias force is exerted by the spring 12 at 25° C, a higher temperature will have to be reached before the force of the spring 12 will reverse its polarity. Consequently, a higher temperature will be required for the force of the spring 12 to overcome the force of the magnetic latch. However, because the force of the magnetic latch also decreases as the ambient temperature increases above the transition temperature of the magnetic keeper 18, an increase in the critical temperature of the bimetallic spring 12 by a certain amount will cause less of an increase in the operating temperatures of the switch 10. Thus, it can be seen that the means previously described for adjusting the angle at which bimetallic spring 12 is mounted to support post 26 provides a type of "vernier" adjustment of the operating temperatures of the switch 10.

In addition, it will be noted that by designing the switch 10 so that the critical temperature of the bimetallic spring 12 is below the transition temperature of the magnetic keeper 18, a snap action capability is provided. This is due to the fact that the actuating force of the bimetallic spring 12 is allowed to build up prior to release by the magnetic latch. This feature is particularly desirable in high electrical current application, such as the cut-off switch for an electrical oven, where "sluggish" switching can cause arcing between the switch contacts. Of course, the quickness of the switching operation can be altered simply by changing the magnetic strength of the latch. However, in order to maintain the same operating temperatures, given a change in the strength of the magnetic latch, the strength of the bimetallic spring 12 would also need to be adjusted.

Accordingly, it will be appreciated that the combination of a temperature responsive spring and a magnetically transformable latch gives the temperature limit switch 10 of the present invention the capability of providing precise temperature control. In particular, a limit switch 10 according to the present invention can provide an estimated tolerance of $\pm 1.5\%$ of the specified temperature rise above room temperature. Given a specified oven temperature of 300° C, this corresponds to a tolerance of approximately 4° C.

Of particular importance to the precision of the present invention is the fact that the bimetallic spring 12 does not conduct current when the switch 10 is in the closed position. Especially when used in relatively high current applications, such as the control of the heating elements in an electrical oven, the temperature effects on the bimetallic spring 12 resulting from the conduction of electrical current can be substantial. And of course, any changes in the temperature of the bimetallic spring 12 which are not caused by changes in ambient temperature impair the accuracy of the switch 10. However, where the current levels to which the switch 10 will be subjected are relatively small, a modification of the switch 10 wherein the bimetallic spring 12 serves as an electrical conductor between the two switch contacts 20 can be employed satisfactorily.

Finally, it will be noted that the temperature responsive bimetallic spring 12 provides the switch 10 with a "built-in" fail safe feature. Specifically, if for some reason the permanent magnet 14 or the magnetic keeper 18 fail to properly perform their latching function, the bimetallic spring 12 will still open and close the switch 10 within approximately the required temperature range, although not with the precise accuracy realized when combined with the magnetic latch. In the example noted above, the operating temperatures of the switch 10 without the benefit of the magnetic latch would be approximately 270° C to open and close the switch 10.

Referring now to FIG. 3, an alternative embodiment of the present invention is shown. The embodiment of the switch 10 illustrated in FIG. 3 provides an alternative means of varying the operating temperatures of the switch 10 within a limited temperature range. The prior art has recognized that the application of pressure or bending force to a non-permanent magnetic material alters the magnetic characteristics of the material. This principal is applied to the embodiment of the present invention illustrated in FIG. 3. Specifically, the magnetic keeper 18, as well as the cavity within the base 24 in which the magnetic keeper 18 is set, are made trapezoidal in shape. Also inserted in the base 24 adjacent the longer parallel edge of magnetic keeper 18 is a pressure plate 44 which is secured against magnetic keeper 18 by a pair of screws 42. By tightening screws 42, pressure is applied to the longer edge of magnetic keeper 18 wedging it within its cavity. By compressing magnetic keeper 18, the transition temperature of the magnet is increased, thereby increasing the operating temperatures of the switch 10. However, it is to be understood that the range of temperature adjustment afforded by this alternative is limited.

Looking now to FIG. 4, a second alternative embodiment of the present invention is shown. The embodiment illustrated in FIG. 4 is intended to provide a switch that includes means for substantially adjusting the operating temperatures of the switch 10. The embodiment of the switch 10 illustrated in FIG. 4 is seen to comprise a pair of magnetic keepers 18*a* and 18*b* that are positioned adjacent to one another in an oversized recess 23 formed in the base 24 of the switch 10. Each of the two magnetic keepers 18*a* and 18*b* has a thermally conductive stud bolt 38 threadedly secured therein that extends through a slot 33 in the wall 34 of the oven. Stud bolts 38 also extend through a similar slot 37 formed in the non-magnetic spacer 36 located at the bottom of recess 23. The permanent magnet 14 is secured to insulating tab 22 and bimetallic spring 12 by a rivet 25 in the same manner as that previously described in connection with the embodiment illustrated in FIGS. 1 and 2.

The recess 23 in the base 24 of the switch 10 is made large enough to accommodate three magnetic keepers so that the position of keepers 18*a* and 18*b* relative to the pole face of permanent magnet 14 is adjustable. Specifically, magnetic keepers 18*a* and 18*b* are adapted to be slidable between a first position in which the pole face of magnetic keeper 18*a* is aligned with that of permanent magnet 14, and a second position in which the pole face of magnetic keeper 18*b* is aligned with that of permanent magnet 14.

The magnetic keepers 18*a* and 18*b* are selected to have different transition temperatures that define the upper and lower limits of the temperature adjustment range of the switch 10. Thus, it can be seen that by varying the proportion of the pole face of each keeper 18*a* and 18*b* that is in magnetic contact with the pole face of permanent magnet 14, the operating temperatures of the switch 10 can accordingly be varied. In addition, by making the width of each magnetic keeper 18*a* and 18*b* the same as the width of permanent magnet 14, the release temperature of the switch 10 can be adjusted to any value between the two transition temperatures of the magnetic keepers 18*a* and 18*b.*

Figure 5:
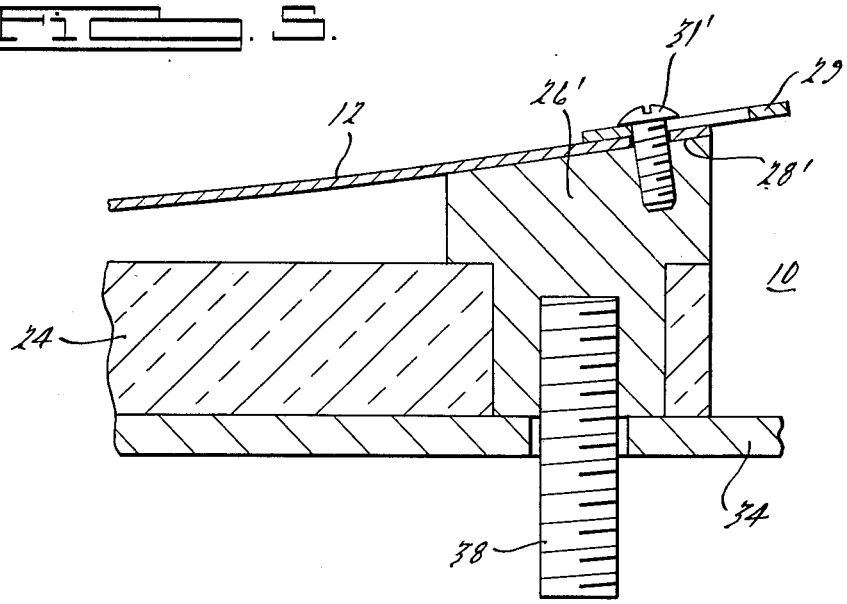
FIG. 5 illustrates a third alternative embodiment of the over-temperature limit switch shown in FIGS. 1 and 2.

Referring now to FIG. 5, a third alternative embodiment of the switch 10 illustrated in FIGS. 1 and 2 is shown. The embodiment illustrated in FIG. 5 provides an additional method of adjusting the operating temperatures of the switch 10 within a limited range. Whereas the preferred embodiment of the switch 10 illustrated in FIGS. 1 and 2 provides means for adjusting the operating temperatures of the switch 10 by adjusting the angle at which the bimetallic spring 12 is mounted to support post 26, the embodiment shown in FIG. 5 accomplishes this by adjusting the active length of bimetallic spring 12. In particular, the switch 10 shown in FIG. 5 comprises a support post 26' having a flat inclined mounting surface 28'. The bimetallic spring 12 is fastened to the mounting surface 28' of support post 26' by a bolt 31' which screws into support post 26' to the right of center of the support post 26', as shown. Due to the increased length of the inclined mounting surface 28', a greater portion of the bimetallic spring 12 rests on the support post 26'.

Clamped on top of bimetallic spring 12 by bolt 31' is a slotted plate 29. By adjusting the location of slotted plate 29 relative to mounting surface 28', it can be seen that the portion of the bimetallic spring 12 clamped to the mounting surface 28' of the support post 26' can be varied. In other words, the pivot point from which bimetallic spring 12 will bend upwardly when sufficiently heated is adjustable by varying the location of slotted plate 29. And, as previously mentioned, one of the factors that determines the critical temperature of the bimetallic spring 12 is the active length of the spring. Thus, by varying the active length of the bimetallic spring 12 the operating temperatures of the switch 10 can be adjusted within a limited range.

While the above description constitutes the preferred embodiments of the present invention, it will be appreciated that the invention is susceptible to modification, variation and change without departing from the proper scope or fair meaning of the accompanying claims.

Having thus described my invention, what is claimed is:

1. A temperature limit switch for interrupting an electrical current comprising:

contact means electrically connected to an external source of electrical current and operative to interrupt said electrical current when opened and conduct said electrical current when closed;

temperature dependent spring means connected to said contact means for exerting a bias force tending to open said contact means as the temperature of said spring means exceeds a first predetermined temperature; and magnetic means electrically isolated from said electrical current for preventing said spring means from opening said contact means until the temperature of said magnetic means exceeds a second predetermined temperature greater than said first predetermined temperature, said magnetic means including a non-permanent magnet having associated therewith a transition temperature substantially equivalent to said second predetermined temperature such that above said second predetermined temperature the magnetic force of said magnetic means is less than the force of said spring means.

2. The temperature limit switch of claim 1 wherein said spring means is electrically isolated from said electrical current.

3. The temperature limit switch of claim 1 wherein the permeability of said non-permanent magnet increases as the temperature of said non-permanent magnet decreases below said transition temperature.

4. The temperature limit switch of claim 3 wherein the magnitude of the force exerted by said spring means decreases as the temperature of said spring means decreases below said second predetermined temperature until the magnetic force of said magnetic means exceeds the force of said spring means thereby closing said contact means.

5. The temperature limit switch of claim 1 further including means for maintaining the temperature of said spring means substantially equivalent with the temperature of said magnetic means.

6. The temperature limit switch of claim 1 wherein said magnetic means further includes a permanent magnet affixed to said spring means and positioned in relation to said non-permanent magnet so that below said second predetermined temperature, said non-permanent magnet conducts a relatively large number of magnetic lines of flux from said permanent magnet and above said second predetermined temperature, said non-permanent magnet conducts a greatly reduced number of magnetic lines of flux from said permanent magnet.

7. The temperature limit switch of claim 3 wherein said non-permanent magnet comprises a nickel-iron alloy.

8. The temperature limit switch of claim 3 wherein said non-permanent magnet comprises a nickel-iron-zinc and/or manganese alloy.

9. The temperature limit switch of claim 4 wherein said temperature dependent spring means comprises a bimetallic strip connected at one end to said contact means.

10. The temperature limit switch of claim 9 wherein said bimetallic strip is fixedly secured at its other end to an inclined mounting surface such that said bimetallic strip is deflected between its two ends.

11. The temperature limit switch of claim 10 wherein said mounting surface is inclined so that the direction of deflection of said bimetallic strip at temperatures below said first predetermined temperature is such that a bias force is exerted by said bimetallic strip tending to close said contact means.

12. The temperature limit switch of claim 11 further including adjustment means associated with said mounting surface for adjusting the amount of bias force exerted by said bimetallic strip at a temperature of 25° C.

13. The temperature limit switch of claim 12 wherein said adjustment means includes means for varying the extent to which said fixedly engaged end of said bimetallic strip conforms to the inclination of said mounting surface.

14. The temperature limit switch of claim 13 wherein said mounting surface has a portion thereof having a greater inclination than the remainder of said surface.

15. The temperature limit switch of claim 11 further including adjustment means associated with said inclined mounting surface for varying the active length of said bimetallic strip.

16. The temperature limit switch of claim 15 wherein said adjustment means includes a slotted plate mounted on top of said other end of said bimetallic strip, said slotted plate being adapted to cover a variable amount of said other end of said bimetallic strip so as to vary the pivot point from which said bimetallic strip deflects upwardly.

17. The temperature limit switch of claim 3 further including pressure adjustment means adapted to apply a variable amount of compressible pressure to said non-permanent magnet for varying the transition temperature of said non-permanent magnet.

18. The temperature limit switch of claim 17 wherein said non-permanent magnet is substantially trapezoidal in shape.

19. The temperature limit switch of claim 18 wherein said pressure adjustment means includes a pressure plate disposed adjacent the longer of said non-permanent magnet's two parallel edges and means for applying pressure near the ends of said pressure plate perpendicular to said parallel edge.

20. A temperature limit switch for interrupting an electrical current comprising:

contact means electrically connected to an external source of electrical current and operative to interrupt said electrical current when opened;

spring means connected to said contact means for exerting a bias force tending to open said contact means;

magnetic means electrically isolated from said electrical current for preventing said spring means from opening said contact means until the temperature of said magnetic means exceeds a first predetermined temperature, said magnetic means having associated therewith a permeability factor that varies with temperature according to a predefined relationship such that above said first predetermined temperature the magnetic force of said magnetic means is less than the force of said spring means; and temperature adjustment means for varying said first predetermined temperature by varying said predefined relationship by which the permeability of said magnetic means varies with temperature.

21. The temperature limit switch of claim 20 wherein said magnetic means includes at least two non-permanent magnets positioned adjacent one another and having associated therewith different transition temperatures and a permanent magnet affixed to said spring means so that said permanent magnet is magnetically attracted to at least one of said non-permanent magnets at temperatures below said first predetermined temperatures.

22. The temperature limit switch of claim 21 wherein said temperature adjustment means includes means for varying the position of said non-permanent magnets relative to said permanent magnet so that the number of magnetic lines of flux from said permanent magnet carried by each of said non-permanent magnets is varied.

23. The temperature limit switch of claim 20 wherein said spring means is temperature dependent so that said bias force is exerted only when the temperature of said source spring means exceeds a second predetermined temperature.

24. The temperature limit switch of claim 23 wherein said second predetermined temperature is lower than said first predetermined temperature.

* * * * *